US011770657B2

(12) United States Patent
Kuchiji et al.

(10) Patent No.: US 11,770,657 B2
(45) Date of Patent: Sep. 26, 2023

(54) PIEZO-ELECTRIC ELEMENT

(71) Applicants: Nisshinbo Micro Devices Inc., Tokyo (JP); DENSO CORPORATION, Kariya (JP)

(72) Inventors: Hiroyuki Kuchiji, Fujimino (JP); Naoki Masumoto, Fujimino (JP); Hideo Yamada, Kariya (JP); Akihiko Teshigahara, Kariya (JP); Atsushi Mizutani, Kariya (JP)

(73) Assignees: NISSHINBO MICRO DEVICES INC., Tokyo (JP); DENSO CORPORATION, Kariya (JP)

( * ) Notice: Subject to any disclaimer, the term of this patent is extended or adjusted under 35 U.S.C. 154(b) by 0 days.

(21) Appl. No.: 17/632,462

(22) PCT Filed: Jul. 28, 2020

(86) PCT No.: PCT/JP2020/028931
§ 371 (c)(1),
(2) Date: Feb. 2, 2022

(87) PCT Pub. No.: WO2021/024865
PCT Pub. Date: Feb. 11, 2021

(65) Prior Publication Data

US 2022/0279285 A1 Sep. 1, 2022

(30) Foreign Application Priority Data

Aug. 6, 2019 (JP) ..... 2019-144234

(51) Int. Cl.
*H04R 17/02* (2006.01)

(52) U.S. Cl.
CPC ..... *H04R 17/02* (2013.01)

(58) Field of Classification Search
CPC ..... H04R 17/02; H04R 17/00; H01L 41/053; H01L 41/083; H01L 41/113; H01L 41/0805; H01L 41/1138
See application file for complete search history.

(56) References Cited

U.S. PATENT DOCUMENTS 11,088,315 B2 * 8/2021 Grosh ..... B81C 1/00158
2005/0193822 A1 9/2005 Amano et al.
(Continued)

FOREIGN PATENT DOCUMENTS

CN 101313628 A 11/2008
JP 5707323 B2 4/2015
(Continued)

OTHER PUBLICATIONS

Translation of CN 101313628 A. (Year: 2008).*
(Continued)

*Primary Examiner* — Brian Ensey
(74) *Attorney, Agent, or Firm* — Oliff PLC

(57) ABSTRACT

A piezo-electric element includes a piezo-electric element part, a support part, and a stretchable film. The piezo-electric element part includes a piezo-electric film and electrodes between which the piezo-electric film is sandwiched in a thickness direction. The support part supports a peripheral portion of the piezo-electric element part. The stretchable film is provided in an oscillation region located inside of the peripheral portion of the piezo-electric element part. The stretchable film also has a higher elasticity than that of the piezo-electric element part.

11 Claims, 9 Drawing Sheets

(56) References Cited

U.S. PATENT DOCUMENTS

| | | | |
|---|---|---|---|
| 2008/0218031 | A1 | 9/2008 | Kuroda et al. |
| 2010/0158283 | A1 | 6/2010 | Kim et al. |
| 2010/0254547 | A1 | 10/2010 | Grosh et al. |
| 2011/0135123 | A1 | 6/2011 | Kim et al. |
| 2013/0329920 | A1 | 12/2013 | Grosh et al. |
| 2014/0339657 | A1 | 11/2014 | Grosh et al. |
| 2018/0138391 | A1 | 5/2018 | Grosh et al. |
| 2021/0029468 | A1 | 1/2021 | Komoto et al. |

FOREIGN PATENT DOCUMENTS

| | | | |
|---|---|---|---|
| TW | 201929277 | A | 7/2019 |
| WO | 2007/060768 | A1 | 5/2007 |

OTHER PUBLICATIONS

May 21, 2021 Office Action Issued in Taiwanese Patent Application No. 109126306.

Oct. 20, 2020 Search Report issued in International Patent Application No. PCT/JP2020/028931.

* cited by examiner

PIEZO-ELECTRIC ELEMENT

CROSS-REFERENCE TO RELATED APPLICATIONS

This application is national stage application of International Application No. PCT/JP2020/028931, filed Jul. 28, 2020, which designates the United States, incorporated herein by reference, and which claims the benefit of priority from Japanese Application No. 2019-144234, filed on Aug. 6, 2019, the entire contents of which are incorporated herein by reference.

FIELD

Embodiments described herein relate generally to a piezo-electric element.

BACKGROUND

There has been known a piezo-electric element that extracts distortion of a piezo-electric film sandwiched between electrode films as a change in voltage. Also, a structure in which slits are formed in a piezo-electric film is disclosed in order to reduce residual stress of the piezo-electric film, the peripheral portion of which is fixed by a support board or the like.

However, the S/N ratio may drop in some conventional technologies (e.g., Japanese Patent No. 5707323).

SUMMARY OF THE INVENTION

Problem to be Solved by the Invention

The present invention has been made in view of the foregoing, and an object of the invention is to provide a piezo-electric element capable of preventing the S/N ratio from dropping.

SUMMARY

A piezo-electric element according to an embodiment includes a piezo-electric element part, a support part, and a stretchable film. The piezo-electric element part includes a piezo-electric film and electrodes, the piezo-electric film being sandwiched between the electrodes in a thickness direction. The support part supports a peripheral portion of the piezo-electric element part. The stretchable film is provided in an oscillation region located inside of the peripheral portion of the piezo-electric element part, the stretchable film having a higher elasticity than that of the piezo-electric element part.

DETAILED DESCRIPTION

Embodiments will be described below in detail with reference to the accompanying drawings. In the following embodiments and modifications, the same reference signs are given to parts having the same structures and functions, and the detailed descriptions thereof may be omitted.

First Embodiment

Figure 1A:
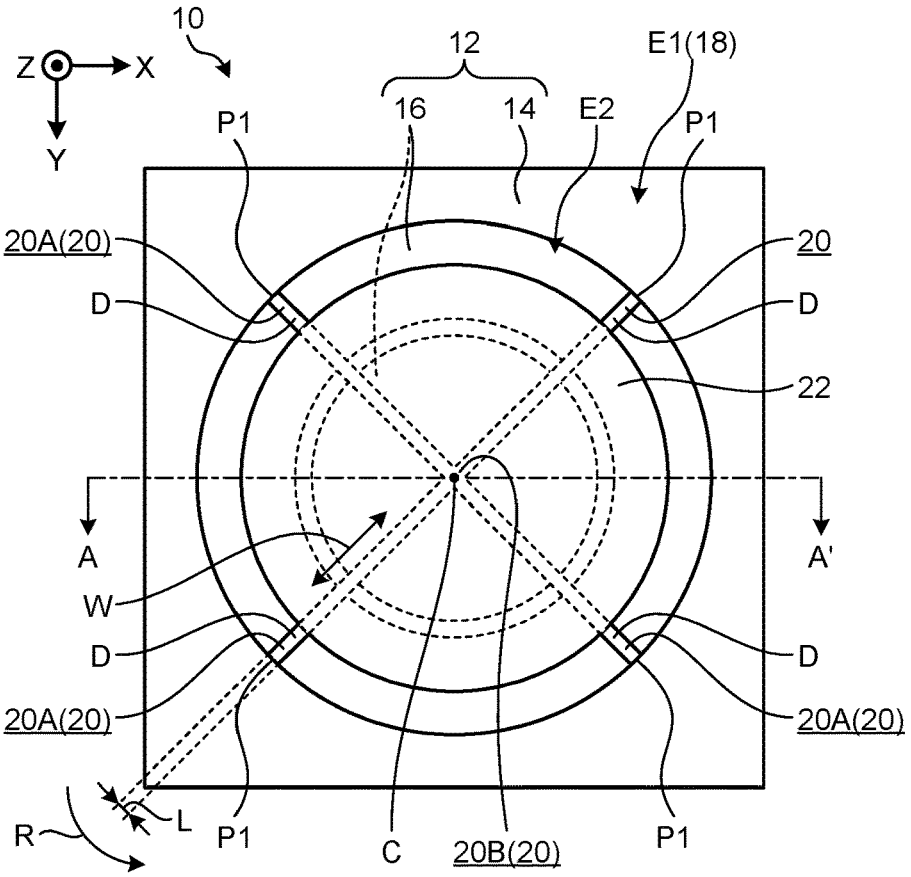
FIG. 1A is a top view of a piezo-electric element.
Figure 1B:
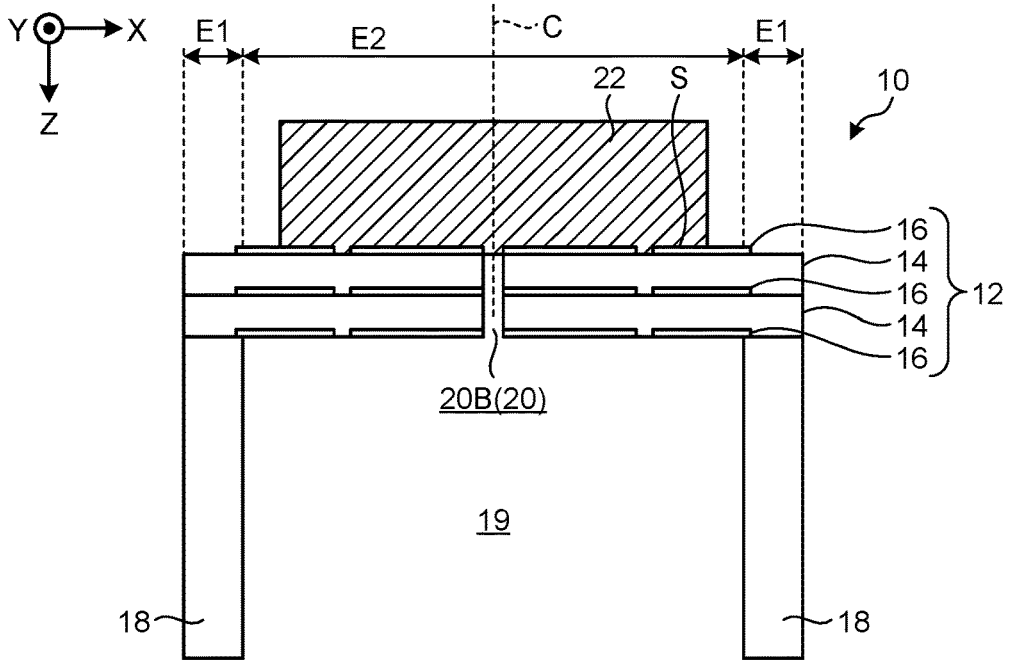
FIG. 1B is a sectional view of the piezo-electric element.

FIG. 1A is an example of a top view of a piezo-electric element 10 according to the present embodiment. FIG. 1B is a sectional view of a piezo-electric element 10 taken along line A-A' illustrated in FIG. 1A.

The piezo-electric element 10 includes a piezo-electric element part 12, a support part 18, and a stretchable film 22.

The piezo-electric element part 12 has a piezo-electric film 14 and electrodes 16 between which the piezo-electric film 14 is sandwiched in a thickness direction (direction of an arrow Z).

The piezo-electric film 14 is a film having an electromechanical effect. The piezo-electric film 14 is made up of publicly known piezo-electric materials. The electrodes 16 are arranged so that the piezo-electric film 14 is sandwiched therebetween in the thickness direction (direction of the arrow Z) of the piezo-electric film 14.

The thickness direction of the piezo-electric film 14 may hereinafter be referred to as a thickness direction Z for description. That is, the thickness direction Z corresponds to the thickness direction of the piezo-electric film 14. Directions orthogonal to the thickness direction Z are referred to as an X direction and a Y direction for description. A two-dimensional plane (XY plane) orthogonal to the thickness direction Z is referred to as an intersecting direction of the thickness direction Z for description.

The piezo-electric element part 12 may be a layered product in which a plurality of the piezo-electric films 14 are layered in the thickness direction Z. In this case, as illustrated in FIG. 1B, the structure may be such that each of the piezo-electric films 14 constituting the layered product is sandwiched between the electrodes 16 in the thickness direction Z. That is, the piezo-electric element part 12 may have a bimorph structure.

The support part 18 supports a peripheral portion E1 of the piezo-electric element part 12. The support part 18 is made by forming a hole 19 in a plate-shaped support board, for example, the hole 19 penetrating the support board in the thickness direction Z. The end face of the support part 18 in the thickness direction Z is disposed in contact with the peripheral portion E1 of the piezo-electric element part 12, whereby the support part 18 supports the peripheral portion E1 of the piezo-electric element part 12.

The peripheral portion E1 is supported by the support part 18, which enables an oscillation region E2 located inside of the peripheral portion E1 in the piezo-electric element part 12 to oscillate. The oscillation region E2 located inside of the peripheral portion E1 is a region located inside of the peripheral portion E1 on the two-dimensional plane along the intersecting direction that intersects the thickness direction Z of the piezo-electric element part 12. In other words, the oscillation region E2 is a region overlapping the hole 19 in a planar view when the piezo-electric element part 12 is viewed from the direction along the thickness direction Z. Consequently, the oscillation region E2 is capable of oscillating without being prevented by the support part 18 in the piezo-electric element part 12.

Meanwhile, the peripheral portion E1 of the piezo-electric element part 12 is a region fixed by the support part 18 so as not to be capable of oscillating. Hereinafter, a planar view when the piezo-electric element 10 is viewed from the direction along the thickness direction Z of the piezo-electric element part 12 is simply referred to as a planar view for description.

In the present embodiment, the oscillation region E2 of the piezo-electric element part 12 will be described with a case taken as an example where the oscillation region E2 is circular in the planar view. That is, in the present embodiment, the support part 18 will be described with a case taken as an example where the support part 18 is a circular, frame-shaped member that has the circular hole 19 in the planar view. Thus, in the present embodiment, the peripheral portion E1 of the piezo-electric element part 12 will be described with a case taken as an example where the peripheral portion E1 is a circular, frame-shaped region in the planar view. Thus, in the present embodiment, the oscillation region E2 of the piezo-electric element part 12 will be described with a case taken as an example where the oscillation region E2 is a circular region in the planar view.

In the present embodiment, the piezo-electric element part 12 is provided with a slit 20.

The slit 20 is provided in the oscillation region E2 of the piezo-electric element part 12. The slit 20 penetrates the oscillation region E2 of the piezo-electric element part 12 in the thickness direction Z.

As illustrated in FIG. 1A, for example, the slit 20 passes through a center C of the circle in the circular oscillation region E2 in the planar view and is also formed along a straight line connecting two points on the circumference.

The slit 20 may be any through hole formed at least in the oscillation region E2 of the piezo-electric element part 12, and the position, the shape, the formation range, and the number of the slit 20 are not limited.

The extending direction of the slit 20 is not limited either. For example, the slit 20 may be extended in a direction from the peripheral portion E1 of the piezo-electric element part 12 toward the oscillation region E2. The slit 20 is preferably extended, in the piezo-electric element part 12, from the oscillation region E2's border with the peripheral portion E1 toward the center C of the oscillation region E2.

For example, as illustrated in FIG. 1A, the slit 20 may be made up of a plurality of first slits 20A and a through hole 20B.

The first slits 20A are the slits 20 that are extended at the border between the peripheral portion E1 of the piezo-electric element part 12 and the oscillation region E2, from first points P1 evenly spaced along a circumferential direction (see an arrow R) of the peripheral portion E1 toward the center C. The circumferential direction of the peripheral portion E1 refers to the direction along the extending direction of the peripheral portion E1 in the planar view (see the arrow R). The center C refers to the center of the intersecting direction (XY direction) that intersects the thickness direction Z in the oscillation region E2 of the piezo-electric element part 12. The distance between the first points P1 adjacent to each other in circumferential direction may be regular or different from each other. However, the distance between the first points P1 is preferably regular.

In the present embodiment, a width L of the first slit 20A will be described with a case taken as an example where the width L is uniform along the extending direction (see an arrow W direction) of the first slit 20A. The width L of the first slit 20A indicates the distance of a direction orthogonal to the extending direction (the arrow W direction) in the planar view in the first slit 20A. In other words, the width L of the first slit 20A is the length of the gap between lateral faces of the oscillation region E2 adjacent to each other via the first slit 20A, the oscillation region E2 being divided by the first slits 20A. The extending direction of the first slit 20A may hereinafter be described as an extending direction W.

The through hole 20B is provided at the center C of the oscillation region E2 of the piezo-electric element part 12, and is continuous with each of the first slits 20A that is extended from the peripheral portion E1 toward the center C.

The stretchable film 22 will be described next.

The stretchable film 22 is a film having elasticity. The stretchable film 22 having elasticity means that the elasticity of the stretchable film 22 is higher than that of the piezo-electric element part 12. In other words, the stretchable film 22 having elasticity means that the stretchable film 22 has a lower Young's modulus than the piezo-electric element part 12 has, or that the stretchable film 22 bends more easily than the piezo-electric element part 12 does.

The stretchable film 22 is provided in the oscillation region E2, which is located inside of the peripheral portion E1 of the piezo-electric element part 12. The stretchable film 22 may constitute a part of the oscillation region E2 of the piezo-electric element part 12. The stretchable film 22 may also be provided on the oscillation region E2 of the piezo-electric element part 12.

In a case where the stretchable film 22 is provided on the oscillation region E2 of the piezo-electric element part 12, the stretchable film 22 has only to be provided in the oscillation region E2 located inside of the peripheral portion E1, on at least one end face of the piezo-electric element part 12 in the thickness direction Z.

FIG. 1B illustrates by way of example a mode in which the stretchable film 22 is provided on a side opposite to the support part 18, in the oscillation region E2 of the piezo-electric element part 12. However, the stretchable film 22 may be disposed on the end face on the support part 18 side (that is, inside the hole 19) in the oscillation region E2 of the piezo-electric element part 12.

Figure 1C:
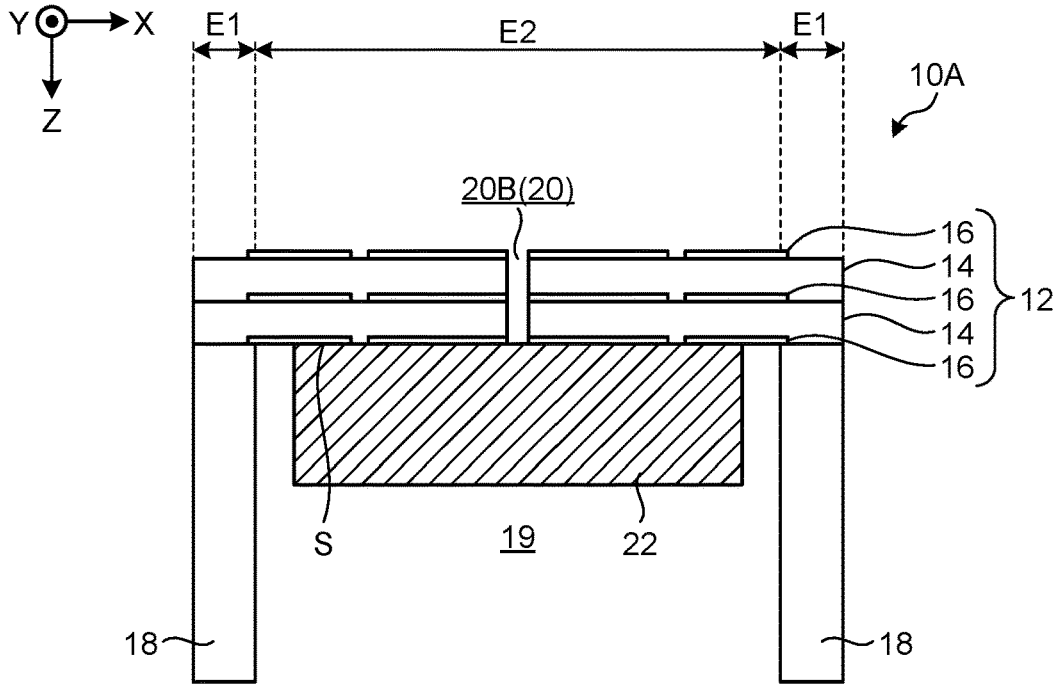
FIG. 1C is a schematic view illustrating an example of the piezo-electric element.

FIG. 1C is a schematic view illustrating an example of a piezo-electric element 10A. The piezo-electric element 10A is an example of the piezo-electric element 10. As illustrated in FIG. 1C, in the piezo-electric element 10A, the stretchable film 22 may be disposed on the end face on the support part 18 side (that is, inside the hole 19) in the oscillation region E2 of the piezo-electric element part 12. The piezo-electric element 10A has the same structure as the piezo-electric element 10 has except that the position of the stretchable film 22 is different. The stretchable film 22 may be provided on each end face in the thickness direction Z in the oscillation region E2 of the piezo-electric element part 12.

As described above, the stretchable film 22 may constitute a part of the oscillation region E2 of the piezo-electric element part 12.

Figure 1D:
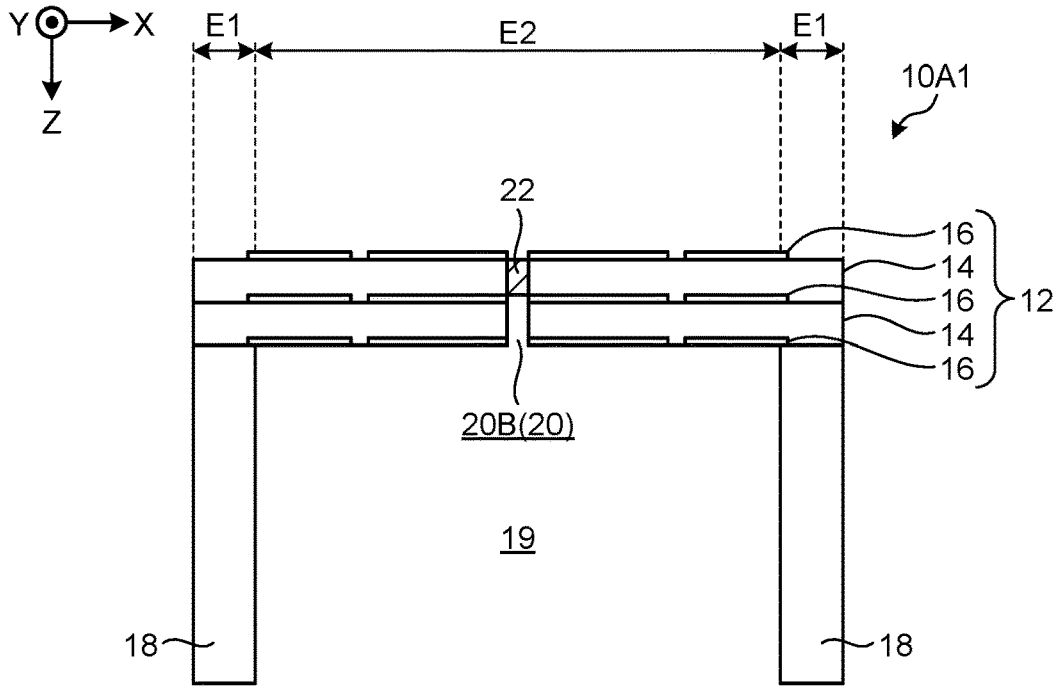
FIG. 1D is a schematic view illustrating another example of the piezo-electric element.
Figure 1E:
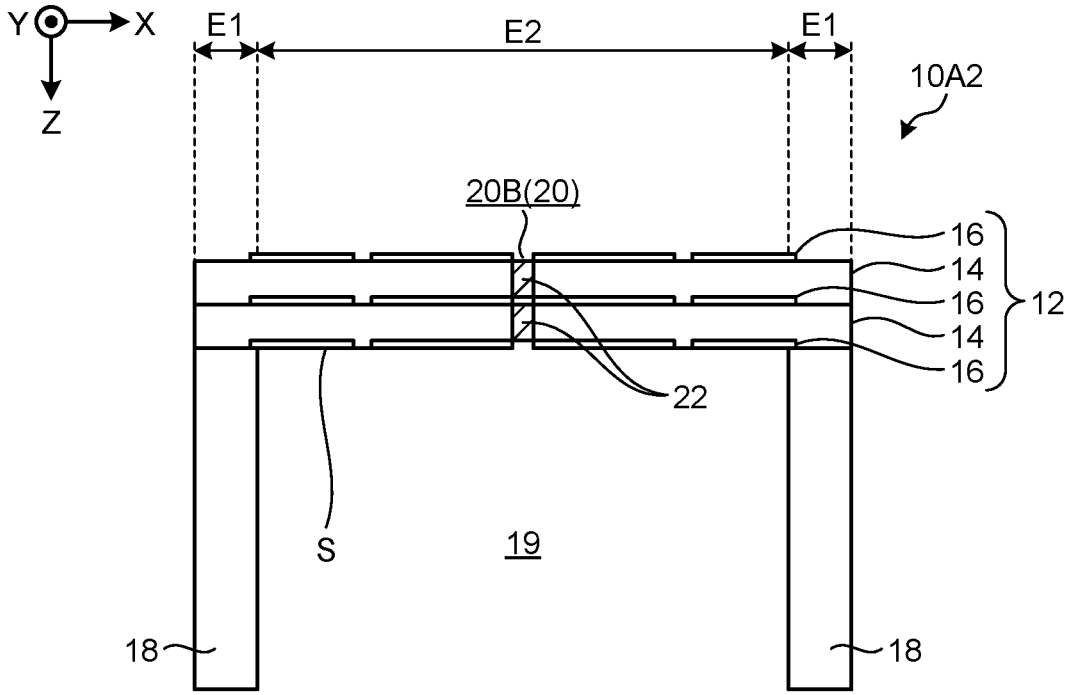
FIG. 1E is a schematic view illustrating still another example of the piezo-electric element.

FIG. 1D is a schematic view illustrating an example of a piezo-electric element 10A1. FIG. 1E is a schematic view illustrating an example of a piezo-electric element 10A2. The piezo-electric element 10A1 and the piezo-electric element 10A2 are examples of the piezo-electric element 10.

As illustrated in FIG. 1D and FIG. 1E, the stretchable film 22 may constitute a part of the oscillation region E2 of the piezo-electric element part 12. In this case, the structure may be such that the stretchable film 22 is disposed in contact with a lateral face of the piezo-electric film 14 in the intersecting direction (XY direction) that intersects the thickness direction Z of the piezo-electric film 14. In other words, the structure may also be such that the stretchable film 22 is disposed so as to fill in at least a part of the slit 20 provided in the oscillation region E2.

Figure 1F:
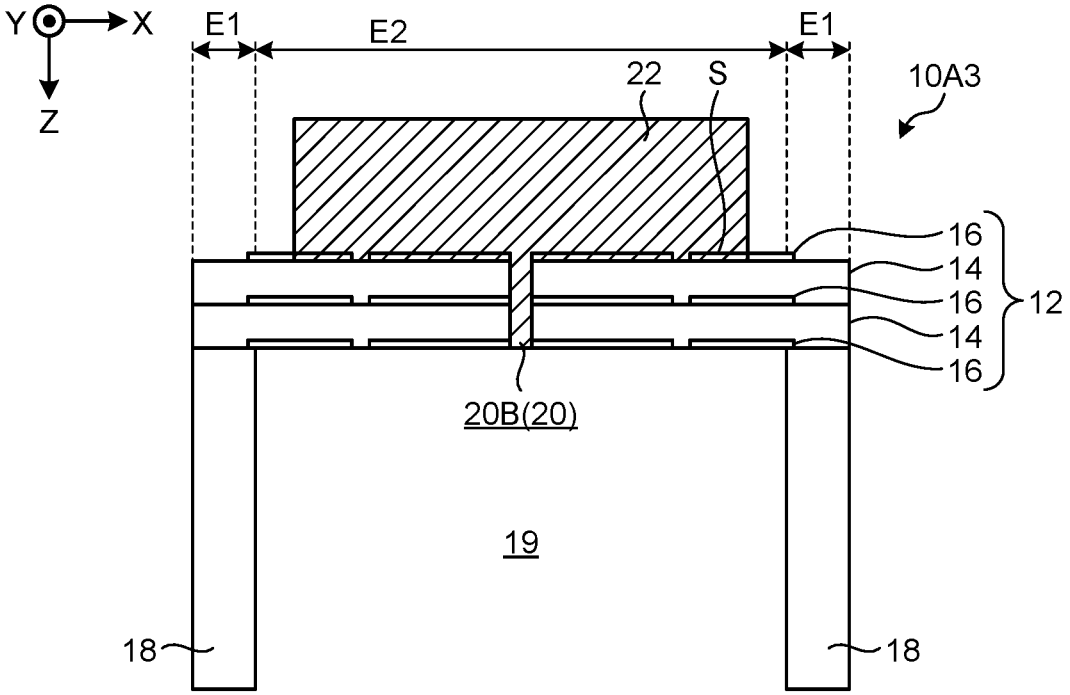
FIG. 1F is a schematic view illustrating still another example of the piezo-electric element.
Figure 1G:
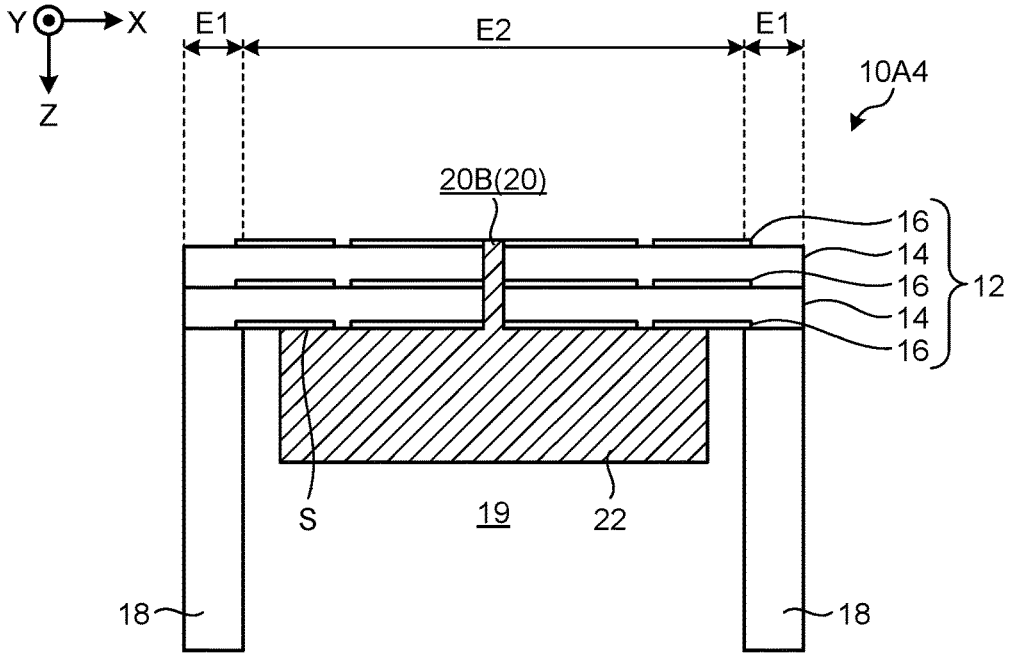
FIG. 1G is a schematic view illustrating still another example of the piezo-electric element.

FIG. 1F is a schematic view illustrating an example of a piezo-electric element 10A3. FIG. 1G is a schematic view illustrating an example of a piezo-electric element 10A4. The piezo-electric element 10A3 and the piezo-electric element 10A4 are examples of the piezo-electric element 10.

As illustrated in FIG. 1F and FIG. 1G, a part of the stretchable film 22 may be embedded in the slit 20 so as to fill in at least a part of the slit 20 provided in the oscillation region E2. That is, the stretchable film 22 may be provided in the oscillation region E2 located inside of the peripheral portion E1, on one end face of the piezo-electric element part 12 in the thickness direction Z, and may also constitute a part of the oscillation region E2 of the piezo-electric element part 12.

The description returns to FIG. 1A and FIG. 1B to continue. In the present embodiment, the stretchable film 22 will be described with a case taken as an example where the stretchable film 22 is provided on a side opposite to the support part 18, in the oscillation region E2 of the piezo-electric element part 12, and also is not embedded in the slit 20.

The stretchable film 22 has only to be disposed in a position overlapping the oscillation region E2 of the piezo-electric element part 12 in the planar view. However, the stretchable film 22 is preferably disposed so as to fill in or cover a region having a higher modulus of elasticity in the oscillation region E2 of the piezo-electric element part 12.

For example, there are cases where the thickness of the piezo-electric film 14, which is a partial region of the oscillation region E2, is smaller than the other regions, and where the piezo-electric film 14, which is a partial region of the oscillation region E2, is composed of a material having a higher modulus of elasticity than the other regions do. In such cases, the oscillation region E2 includes a region having a higher modulus of elasticity than the other regions of the oscillation region E2 do.

For example, assume that the center C portion has a higher modulus of elasticity than regions other than the center C have in the oscillation region E2 of the piezo-electric element part 12. In this case, the stretchable film 22 has only to be disposed in a region covering at least a part of the center C in the oscillation region E2 of the piezo-electric element part 12.

In a case where the stretchable film 22 is disposed so as to fill in at least a part of the slit 20 provided in the oscillation region E2, a region of the slit 20 filled in by the stretchable film 22 is a region having a high modulus of elasticity. Thus, the stretchable film 22 may further be disposed so as to further cover the region of the slit 20 filled in by the stretchable film 22 in this case.

In a case where any slit 20 that is not filled in by the stretchable film 22 is provided in the oscillation region E2 of the piezo-electric element part 12, a region of the piezo-electric element part 12 in which the relevant slit 20 is provided corresponds to a region having a higher modulus of elasticity. Consequently, the stretchable film 22 is preferably disposed in a position described below in the oscillation region E2 in this case.

Specifically, the stretchable film 22 is disposed so as to cover at least a part of an opening of the slit 20 in the oscillation region E2 of the piezo-electric element part 12.

FIG. 1A illustrates by way of example a case where the stretchable film 22 is disposed so as to cover at least a part of the opening of the slit 20 in the oscillation region E2.

The stretchable film 22 being disposed so as to cover at least a part of the opening of the slit 20 in the oscillation region E2 enables a region of the slit 20 that is not covered by the stretchable film 22 to function as a hole through which the air in the hole 19 passes. Consequently, the piezo-electric element part 12 can be prevented from cracking in this case.

From the viewpoint toward effectively preventing a reduction in sensitivity characteristics resulting from a reduction in acoustic resistance and preventing a reduction in S/N ratio, the stretchable film 22 is preferably disposed so as to cover the entire opening of the slit 20 in the oscillation region E2.

Although the stretchable film 22 has only to be disposed in the oscillation region E2 of the piezo-electric element part 12, the stretchable film 22 preferably does not cover at least one end face of the peripheral portion E1 in the thickness direction Z.

Also, the stretchable film 22 is preferably disposed so as to continuously cover the through hole 20B provided in the center C of the oscillation region E2 and a part of each of the first slits 20A that is continuous with the through hole 20B. The stretchable film 22 covers a part of the opening of the slit 20, thereby enabling the piezo-electric element part 12 separated by the slit 20 to be integrated. In this case, an opening region D of the first slit 20A that is not covered by the stretchable film 22 is preferably an end of the first slit 20A on the peripheral portion E1 side.

Disposing the stretchable film 22 so as to cover the through hole 20B provided in the center C of the oscillation region E2 can increase the oscillation of the oscillation region E2 caused by acoustic pressure or the oscillation of the oscillation region E2 caused by alternating voltage that has been applied to the electrodes 16 as compared with a case where the stretchable film 22 is disposed so as to cover regions other than the center C.

The stretchable film 22 may have any thickness as long as it does not prevent the oscillation region E2 of the piezo-electric element part 12 from oscillating, and the thickness may be adjusted as appropriate in accordance with the constituent material and the like of the stretchable film 22.

The constituent material of the stretchable film 22 may be anything as long as the material has a higher elasticity than that of the piezo-electric element part 12, and is not limited. For example, the stretchable film 22 may be composed of an organic film or a metallic film.

In a case where the stretchable film 22 is composed of an organic film, polyurethane, for example, is preferably used for the stretchable film 22.

The Young's modulus of an organic film is very low as compared with the piezo-electric element part 12. Thus, the stretchable film 22 being composed of an organic film can reduce residual stress of the stretchable film 22 from affecting the resonance frequency of the oscillation region E2 of the piezo-electric element part 12.

In a case where the stretchable film 22 is composed of a metallic film, a material generally used in the manufacturing process of semiconductors, for example, is preferable for the stretchable film 22, and among others, Al, Ti, Au, Ag, Cu, Ni, Mo, Pt, or an alloy containing these is preferable.

The stretchable film 22 being composed of a metallic film can increase the width L of the slit 20 as compared with the case where the stretchable film 22 is composed of an organic film. Additionally, a metallic film has a high compatibility with the manufacturing process of the piezo-electric element part 12 (process of microelectromechanical systems (MEMS), for example), which increases flexibility in process design. In a case where the stretchable film 22 is composed of a metallic film, age deterioration due to hydrolysis and the like can be prevented and heat resistance and light resistance are also excellent as compared with the case where the stretchable film 22 is composed of an organic film. In this case, the reliability of the piezo-electric element part 12 can thus be increased. To achieve a desired elasticity, at least one of the thickness and the shape of the stretchable film 22 may further be adjusted.

From the viewpoint toward preventing the stretchable film 22 from coming off the piezo-electric element part 12, a contact surface S of the piezo-electric element part 12 with the stretchable film 22 preferably has unevenness. The surface roughness of the contact surface S with unevenness may be adjusted as appropriate in accordance with the constituent material and the like of the stretchable film 22 so that the stretchable film 22 can be prevented from coming off the piezo-electric element part 12. The unevenness on the contact surface S may be formed by providing a plurality of holes, depressions, or apertures in the contact surface S.

The operations of the piezo-electric element 10 will be described next.

In the piezo-electric element part 12, the oscillation region E2 of the piezo-electric element part 12 oscillates. The oscillation region E2 of the piezo-electric element part 12 is caused to oscillate by acoustic pressure, such as an audible sound or an ultrasonic range, for example. The oscillation region E2 of the piezo-electric element part 12 is also caused to oscillate by alternating voltage that has been applied to the electrodes 16. The frequency of the alternating voltage is the frequency of an audible sound or an ultrasonic range, for example. The acoustic pressure is not limited to acoustic pressure caused by an audible sound or an ultrasonic range. Similarly, the frequency of the alternating voltage applied to the electrodes 16 is not limited to a frequency of an audible sound or an ultrasonic range.

When the oscillation region E2 of the piezo-electric element part 12 is warped by acoustic pressure or the like, a transverse piezoelectric effect causes polarization in the interior thereof, and an electric signal is extracted through the electrodes 16.

In the present embodiment, the oscillation region E2 of the piezo-electric element part 12 is provided with the stretchable film 22. Providing the stretchable film 22 can prevent the oscillation region E2 of the piezo-electric element part 12 from bending. Consequently, residual stress of the stretchable film 22 is reduced. The S/N ratio of the piezo-electric element 10 can thus be prevented from dropping. In a case where the stretchable film 22 is provided with the slit 20, a reduction in acoustic resistance arising from an increased gap between regions facing each other via the slit 20 in the oscillation region E2 can be prevented. Consequently, also in a case where the oscillation region E2 is provided with the slit 20, providing the stretchable film 22 can prevent the S/N ratio of the piezo-electric element 10 from dropping.

As described above, the piezo-electric element 10 of the present embodiment includes: the piezo-electric element part 12 having the piezo-electric film 14 and the electrodes 16 between which the piezo-electric film 14 is sandwiched in the thickness direction Z; the support part 18 supporting the peripheral portion E1 of the piezo-electric element part 12; and the stretchable film 22. The stretchable film 22 is provided in the oscillation region E2, which is located inside of the peripheral portion E1 of the piezo-electric element part 12. The stretchable film 22 also has a higher elasticity than the piezo-electric element part 12 does.

Conventionally, in a piezo-electric film the peripheral portion of which is fixed, the resonance frequency varies in accordance with the residual stress, which may lead to a reduction in S/N ratio and a reduction in sensitivity characteristics. Also, in a conventional piezo-electric element in which a slit is provided in a piezo-electric film to have a cantilever structure, bending piezo-electric film or electrode films increases a substantial gap between beams, which may reduce acoustic resistance. Thus, there are some cases where the S/N ratio may drop in conventional piezo-electric elements. There are also some cases where the sensitivity characteristics may drop in conventional piezo-electric elements.

Meanwhile, in the piezo-electric element 10 of the present embodiment, the stretchable film 22 having a higher elasticity than that of the piezo-electric element part 12 is provided in the oscillation region E2 located inside of the peripheral portion E1 supported by the support part 18, in the piezo-electric element part 12.

Consequently, the piezo-electric element 10 of the present embodiment enables a reduction in residual stress on the piezo-electric element part 12, and can prevent the S/N ratio from dropping.

Therefore, the piezo-electric element 10 of the present embodiment can prevent the S/N ratio from dropping.

In addition to the above effect, the piezo-electric element 10 of the present embodiment can also prevent the sensitivity characteristics from dropping.

In the piezo-electric element 10 of the present embodiment, even in a case where the oscillation region E2 is provided with the slit 20, providing the stretchable film 22 can prevent the oscillation region E2 from bending. Consequently, the gap (that is, the width L) between regions facing each other via the slit 20 in the oscillation region E2 can be prevented from increasing. Even in a case where the oscillation region E2 bends, disposing the stretchable film 22 so as to cover at least a part of the slit 20 can prevent acoustic resistance from dropping.

Consequently, the piezo-electric element 10 of the present embodiment can prevent acoustic resistance from dropping, and can prevent the S/N ratio and the sensitivity characteristics from dropping.

The stretchable film 22 has a higher elasticity than the piezo-electric element part 12 does. Consequently, residual stress of the stretchable film 22 can be prevented from adversely affecting the resonance frequency. Oscillation of the oscillation region E2 in the piezo-electric element part 12 also prevents the stretchable film 22 from being broken.

In the piezo-electric element 10 of the present embodiment, providing the stretchable film 22 to the oscillation region E2 can easily prevent the S/N ratio and the sensitivity characteristics from dropping, which also makes it possible to easily prevent yields of the piezo-electric element part 12 during manufacturing from decreasing.

Because the piezo-electric element 10 of the present embodiment includes the stretchable film 22, sensitivity to alternating voltage in the low-frequency region or acoustic pressure, in particular, can be enhanced.

The opening shape and the opening dimensions of the through hole 20B can be adjusted as desired.

Figure 1H:
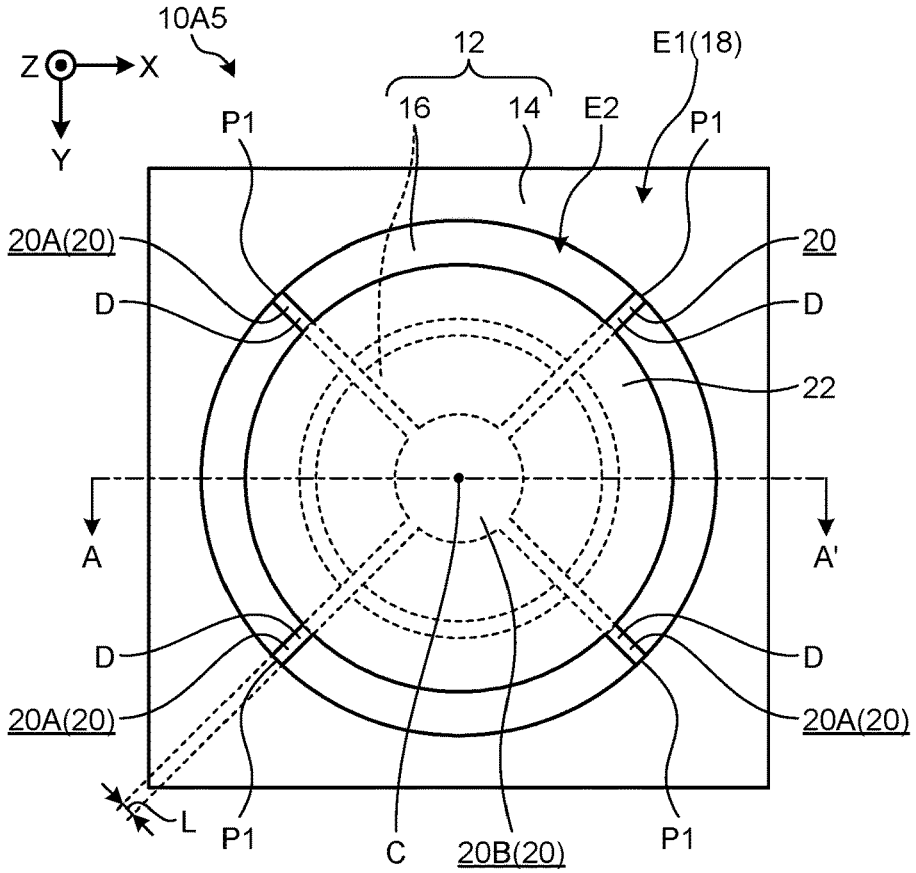
FIG. 1H is a top view of a piezo-electric element.
Figure 1I:
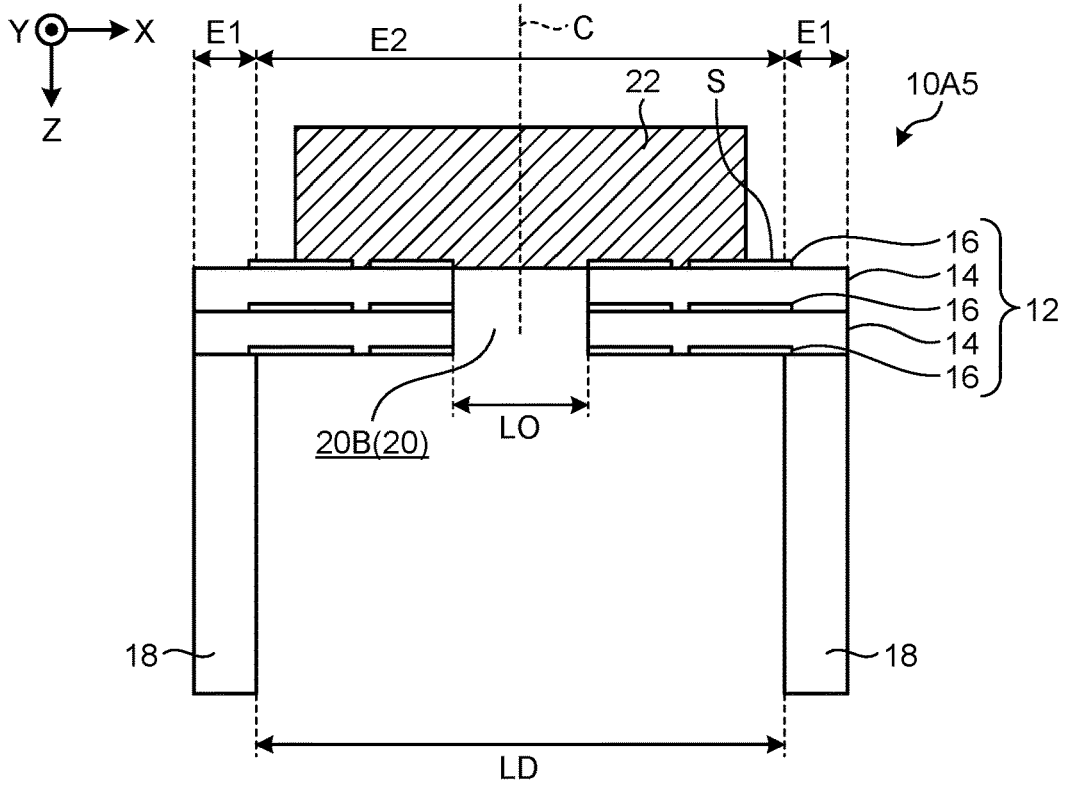
FIG. 1I is a sectional view of the piezo-electric element.

FIG. 1H is a top view of an example of a piezo-electric element 10A5. FIG. 1I is a sectional view of the piezo-electric element 10A5 taken along line A-A' illustrated in FIG. 1H. The piezo-electric element 10A5 is an example of the piezo-electric element 10.

As illustrated in FIG. 1H and FIG. 1I, the through hole 20B of the piezo-electric element 10A5 has a larger opening shape than the through hole 20B of the piezo-electric element 10 illustrated in FIG. 1A and FIG. 1B does. Specifically, in the example illustrated in FIG. 1H and FIG. 1I, the through hole 20B has a circular opening shape and an opening diameter LO.

The opening diameter LO of the through hole 20B can be adjusted as desired.

In an example, the opening diameter LO may be adjusted in accordance with the size of the oscillation region E2 and the sensitivity characteristics. More specifically, a designer can determine the opening diameter LO on the basis of the relation between the ratio of the opening diameter LO to the size of the oscillation region E2, that is, herein a diameter LD of the oscillation region E2, and the reception sensitivity of the piezo-electric element part 12.

Figure 1J:
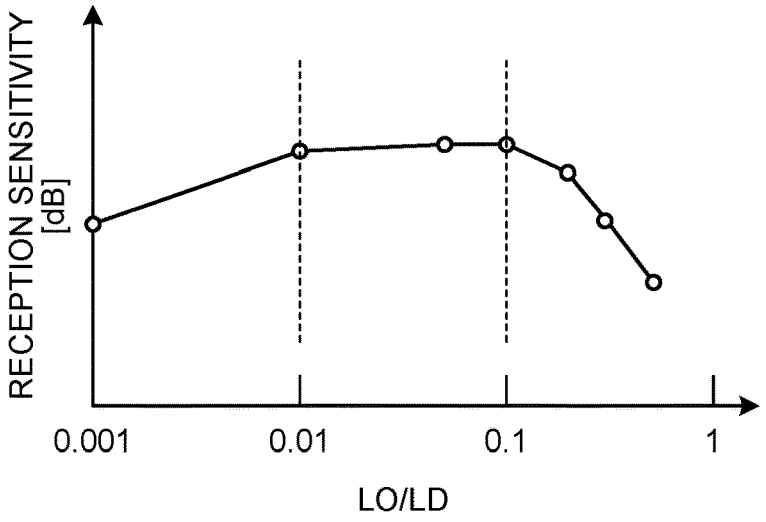
FIG. 1J is a graph illustrating the relation between the ratio of the opening diameter of a through hole to the diameter of an oscillation region and the reception sensitivity of a piezo-electric element part.

FIG. 1J is a graph illustrating the relation between a ratio LO/LD of the opening diameter LO of the through hole 20B to the diameter LD of the oscillation region E2 and the reception sensitivity of the piezo-electric element part 12. FIG. 1J indicates that, when the ratio LO/LD is in a range of 0.01 to 0.1, the reception sensitivity is substantially constant, and that, when the ratio LO/LD falls outside the range of 0.01 to 0.1, the reception sensitivity significantly decreases. Therefore, if the designer sets the opening diameter LO so that the ratio LO/LD falls within the range of 0.01 to 0.1, the piezo-electric element 10A5 having high sensitivity characteristics can be obtained.

Although FIG. 1H illustrates the circular opening shape by way of example, the same effect can be achieved by having a polygonal shape and reading LO as the diameter of its circumscribed circle. Furthermore, the stretchable film 22 is not embedded in the interior of the through hole 20B in FIG. 1I, but may be embedded in the through hole 20B.

A method for determining the opening diameter LO of the through hole 20B is not limited to the foregoing. The ratio LO/LD of the opening diameter LO of the through hole 20B to the diameter LD of the oscillation region E2 does not have to fall within the range of 0.01 to 0.1. The opening shape of the through hole 20B is not limited to a circular shape either.

Second Embodiment

The above embodiment has been described with the case taken as an example where the width L of the first slit 20A is uniform along the extending direction (arrow W direction) of the first slit 20A. In the present embodiment, a case will be described where the width L of the first slit 20A differs from that in the above embodiment.

Figure 2A:
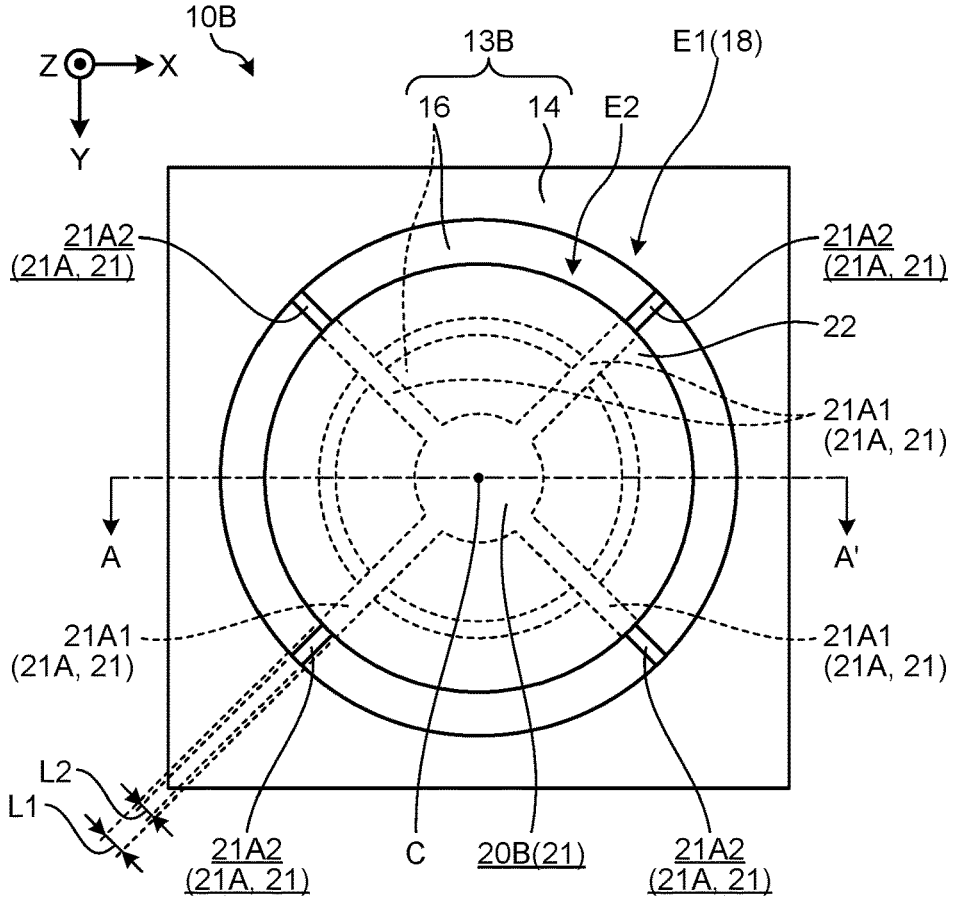
FIG. 2A is a top view of a piezo-electric element.
Figure 2B:
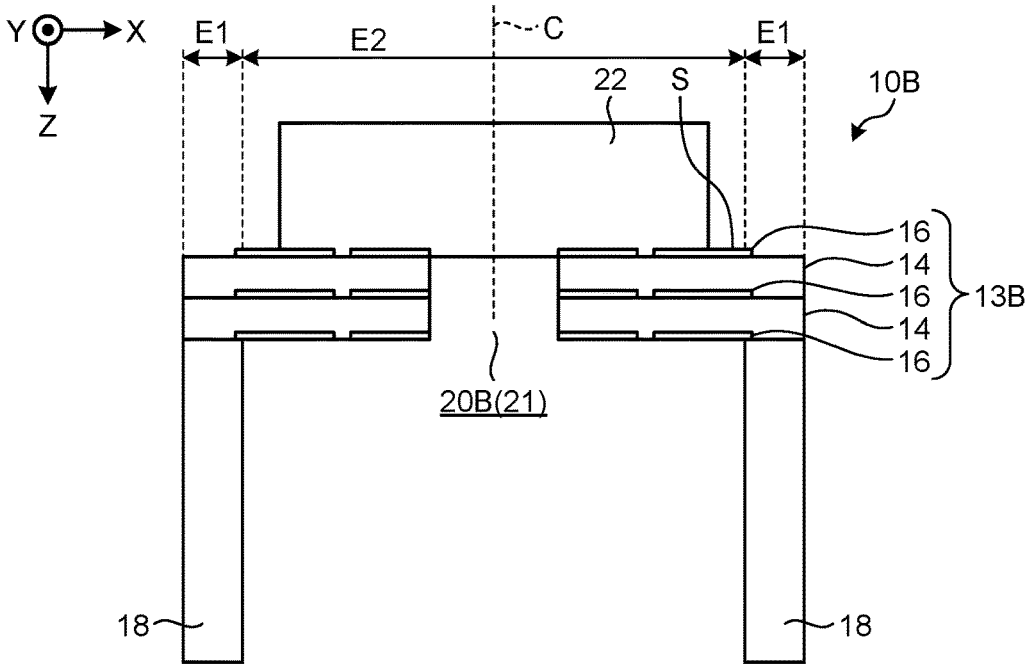
FIG. 2B is a sectional view of the piezo-electric element.

FIG. 2A is an example of a top view of a piezo-electric element 10B according to the present embodiment. FIG. 2B is a sectional view of the piezo-electric element 10B taken along line A-A' illustrated in FIG. 2A.

The piezo-electric element 10B has the same structure as the piezo-electric element 10 of the first embodiment has except that the width L of the slit 20 differs from that in the first embodiment.

The piezo-electric element 10B includes a piezo-electric element part 13B, the support part 18, and the stretchable film 22. The piezo-electric element part 13B has the piezo-electric film 14 and the electrodes 16. The piezo-electric element part 13B is provided with a slit 21. The piezo-electric element part 13B is the same as the piezo-electric element part 12 in the above embodiment except that the piezo-electric element part 13B includes the slit 21 in place of the slit 20.

The slit 21 is made up of a plurality of first slits 21A and the through hole 20B. The through hole 20B is the same as that in the above embodiment. The first slits 21A are the same as the first slits 20A in the above embodiment except that the width L is different.

In the present embodiment, the stretchable film 22 is disposed so as to continuously cover a part of each of the first slits 21A and the through hole 20B.

Herein, in the present embodiment, a slit width L1 of a covered region 21A1 of the first slit 21A that is covered by the stretchable film 22 is larger than a slit width L2 of a non-covered region 21A2 that is not covered by the stretchable film 22.

Making the slit width L1 of the covered region 21A1 of the slit 21 larger than the slit width L2 of the non-covered region 21A2 enables a reduction in stress on the stretchable film 22.

The width L of the first slit 21A preferably increases in stages or in succession with getting closer to the center C from the border between the oscillation region E2 and the peripheral portion E1.

Figure 2C:
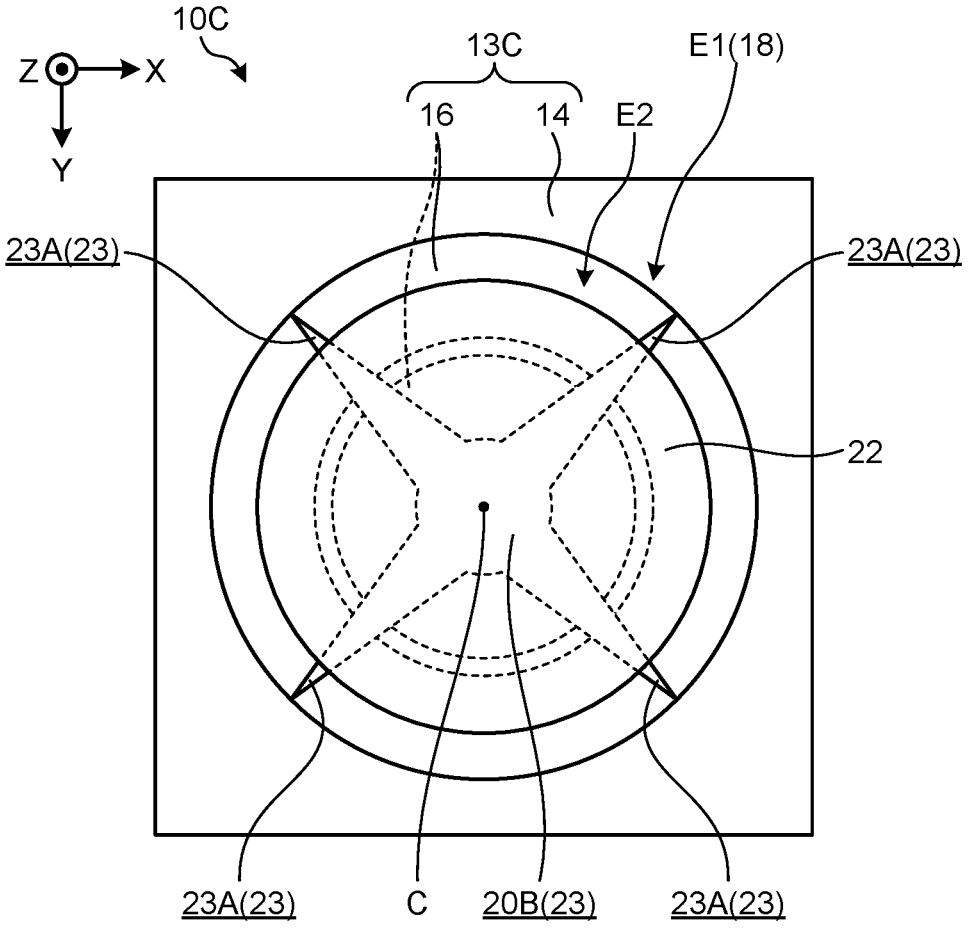
FIG. 2C is a top view of a piezo-electric element.

FIG. 2C is a schematic view illustrating an example of a piezo-electric element 10C. The piezo-electric element 10C includes a piezo-electric element part 13C, the support part 18, and the stretchable film 22. The piezo-electric element part 13C has the piezo-electric film 14 and the electrodes 16. The piezo-electric element part 13C is provided with a slit 23. The piezo-electric element part 13C is the same as the piezo-electric element part 13B (see FIG. 2A and FIG. 2B) except that the piezo-electric element part 13C includes the slit 23 in place of the slit 21.

The slit 23 is made up of a plurality of first slits 23A and the through hole 20B. The through hole 20B is the same as that in the above embodiment. The first slits 23A are the same as the first slits 20A in the above embodiment except that the width L is different.

As illustrated in FIG. 2C, the width L of the first slit 23A may be larger with getting closer to the center C.

The description returns to FIG. 2A and FIG. 2B to continue. As described above, in the piezo-electric element 10B of the present embodiment, the slit width L1 of the covered region 21A1 of the first slit 21A that is covered by the stretchable film 22 is larger than the slit width L2 of the non-covered region 21A2 that is not covered by the stretchable film 22.

In addition to the above effect, the piezo-electric elements 10B, 10C of the present embodiment can reduce stress on the stretchable film 22 when the slit width L1 of the covered region 21A1 of the first slit 21A is made larger than the slit width L2 of the non-covered region 21A2.

(First Modification)

The shape of the stretchable film 22 is not limited to a planar shape along the intersecting direction (direction along the XY plane) that intersects the thickness direction Z. For example, at least a partial region of the stretchable film 22 may have a bellows shape.

Figure 3A:
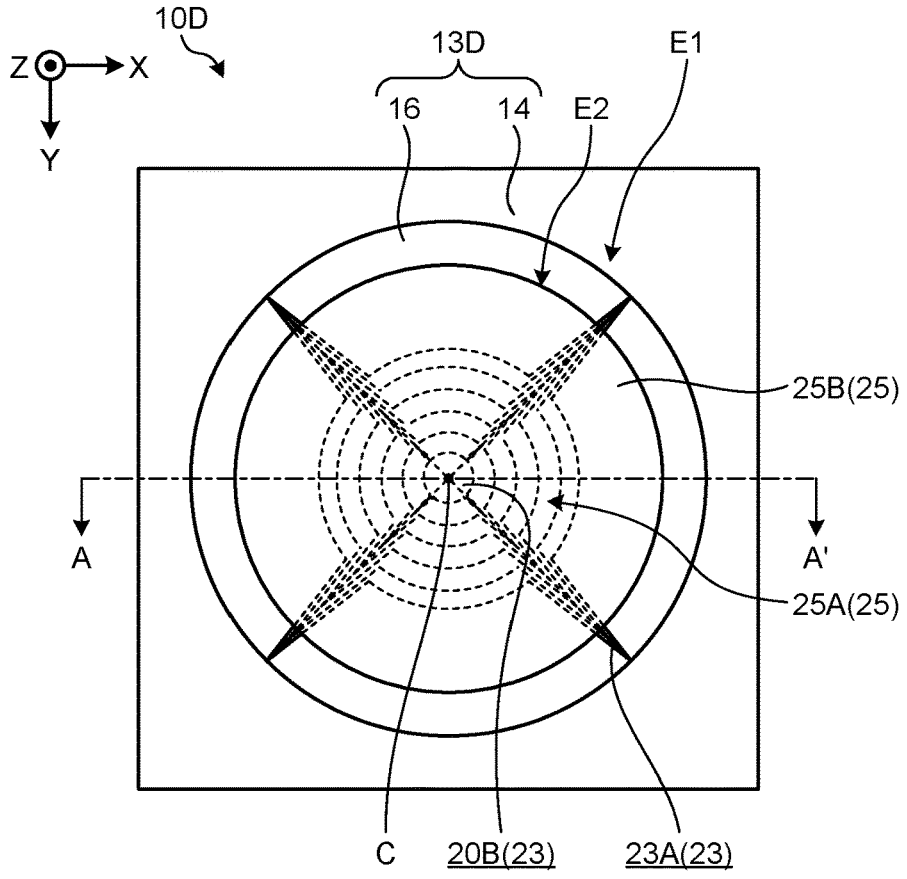
FIG. 3A is a top view of a piezo-electric element.
Figure 3B:
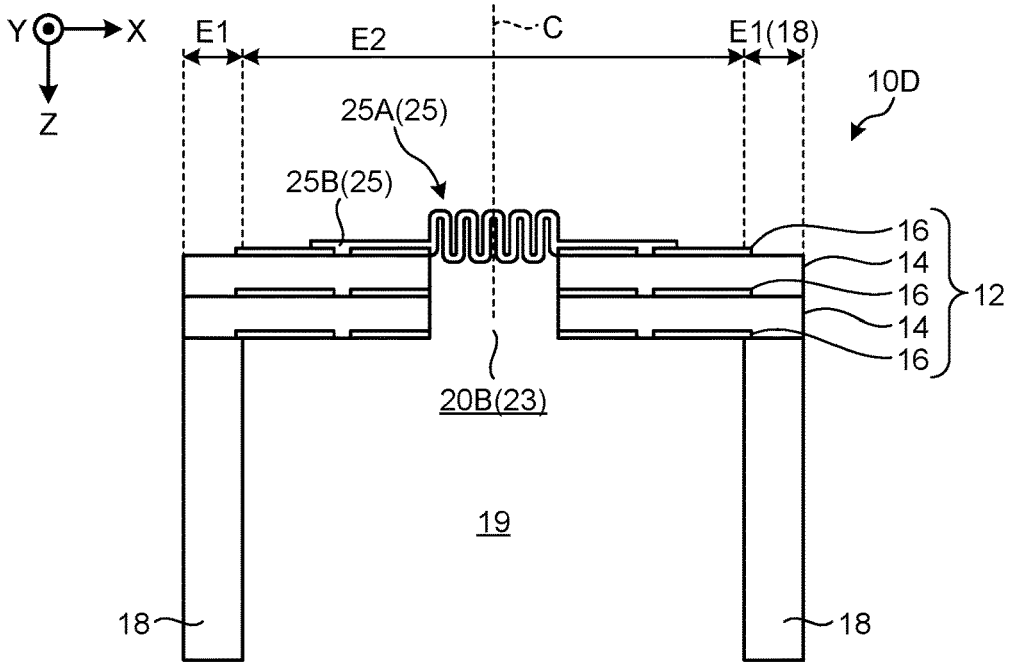
FIG. 3B is a sectional view of the piezo-electric element.

FIG. 3A is an example of a top view of a piezo-electric element 10D according to the present modification. FIG. 3B is a sectional view of the piezo-electric element 10D taken along line A-A' illustrated in FIG. 3A.

The piezo-electric element 10D includes a piezo-electric element part 13D, the support part 18, and a stretchable film 25. The piezo-electric element 10D includes the stretchable film 25 in place of the stretchable film 22 of the piezo-electric element 10C (see FIG. 2C) according to the above second embodiment. The stretchable film 25 is the same as the stretchable film 22 except that the shape differs from that of the stretchable film 22.

At least a partial region of the stretchable film 25 is bellows so as to be stretchable in the intersecting direction (XY direction) that intersects the thickness direction Z.

For example, the stretchable film 25 is made up of a bellows region 25A and a planar region 25B. The bellows region 25A is a region that is bellows-folded by a repetition of mountain folds and valley folds so as to be stretchable in the intersecting direction (XY direction). The planar region 25B is a region having a two-dimensional planar shape along the intersecting direction (XY direction). In the stretchable film 25, a region overlapping an opening of the slit 23 in the planar view is the bellows region 25A, and a region being in contact with the oscillation region E2 of the piezo-electric element part 13D is the planar region 25B.

In this manner, configuring the stretchable film 25 to include the bellows region 25A having a bellows shape easily enables the stretchable film 25 to acquire greater elasticity.

Even in a case where the stretchable film 25 may fail to achieve a desired elasticity because of using a metallic film or the like, the desired elasticity can be achieved by adjusting the shape of the stretchable film 25 to be bellows.

Also, by disposing the bellows region 25A in the region overlapping the opening of the slit 23 in the planar view in the oscillation region E2, sensitivity characteristics of the piezo-electric element part 13D can be effectively enhanced.

The stretchable film 25 may have any desired shape as long as it is possible to improve the elasticity of the stretchable film 25, and is not limited to having a bellows shape. That is, at least a partial region of the stretchable film 25 has only to have a shape that is stretchable in the intersecting direction (XY direction) that intersects the thickness direction Z.

(Second Modification)

The above embodiments and the modification have been described with the case taken as an example where the oscillation region E2 is circular in the planar view. The above embodiments and the modification have also been described with the case taken as an example where the support part 18 has the circular hole 19 in the planar view and is a circular, frame-shaped member. Thus, the above embodiments and the modification have been described with the case taken as an example where the peripheral portion E1 is a circular, frame-shaped region in the planar view and the oscillation region E2 is a circular region in the planar view.

However, the support part 18, the hole 19 of the support part 18, the peripheral portion E1, and the oscillation region E2 are not limited to having circular shapes.

Figure 4:
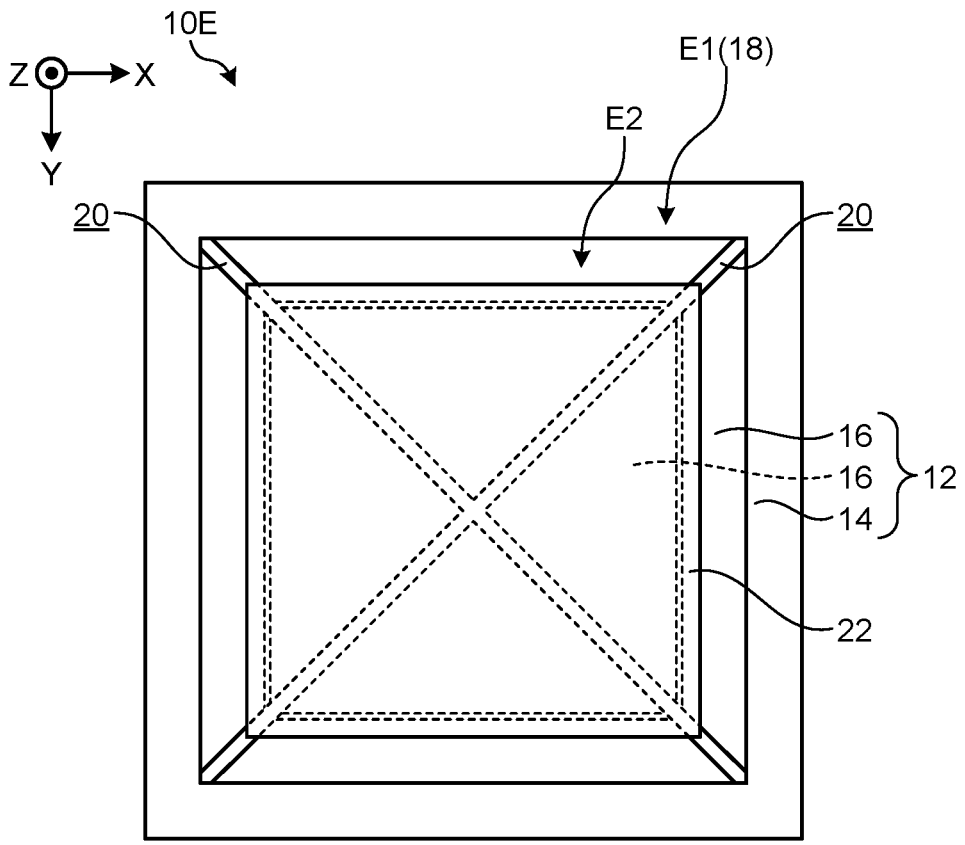
FIG. 4 is a top view of a piezo-electric element.

For example, the oscillation region E2 may be rectangular or polygonal in the planar view. FIG. 4 is a top view illustrating an example of a piezo-electric element 10E.

The piezo-electric element 10E includes the piezo-electric element part 12, the support part 18, and the stretchable film 22. The stretchable film 22 is provided with the slits 20. The piezo-electric element 10E is the same as the piezo-electric element 10 of the above embodiment except that the shape is different.

As illustrated in FIG. 4, the piezo-electric element 10E may include: the piezo-electric element part 12 that has a square shape in the planar view; the peripheral portion E1 that has a square shape and that is supported by the support part 18, which is a frame member having a square shape in the planar view; the oscillation region E2 that has a square shape in the planar view; and the stretchable film 22 that has a square shape in the planar view.

The extent of the applicability of the piezo-electric element 10, the piezo-electric element 10B, the piezo-electric element 10C, the piezo-electric element 10D, and the piezo-electric element 10E that have been described in the above embodiments and modifications is not limited. For example, the piezo-electric element 10, the piezo-electric element 10B, the piezo-electric element 10C, the piezo-electric element 10D, and the piezo-electric element 10E that have been described in the above embodiments and modifications can suitably be applied to microelectromechanical systems (MEMS).

According to one embodiment, the S/N ratio can be prevented from dropping.

Although the embodiments and modifications of the present invention have been described, these embodiments and modifications are presented for illustrative purposes only and are not intended to limit the scope of the invention. These novel embodiments and modifications can be implemented in various other forms, and various omissions, substitutions, and modifications can be made without departing from the spirit of the invention. These embodiments and modifications are included in the scope and the spirit of the invention, and are also included in the inventions described in claims and their equivalents.

What is claimed is:

1. A piezo-electric element comprising:

a piezo-electric element part including a piezo-electric film and electrodes, the piezo-electric film being sandwiched between the electrodes in a thickness direction;

a support part supporting a peripheral portion of the piezo-electric element part; and a stretchable film (i) in an oscillation region inside of the peripheral portion of the piezo-electric element part and (ii) having a higher elasticity than the piezo-electric element part, wherein the piezo-electric element part has at least one end face in the thickness direction, and the stretchable film (i) covers the at least one end face in the oscillation region in the thickness direction and (ii) does not cover the at least one end face in the peripheral portion in the thickness direction.

2. A piezo-electric element comprising:

a piezo-electric element part including a piezo-electric film and electrodes, the piezo-electric film being sandwiched between the electrodes in a thickness direction;

a support part supporting a peripheral portion of the piezo-electric element part; and a stretchable film (i) in an oscillation region inside of the peripheral portion of the piezo-electric element part and (ii) having a higher elasticity than the piezo-electric element part; wherein the piezo-electric element part includes a slit in the oscillation region that penetrates the piezo-electric element part in the thickness direction, the stretchable film (i) covers at least a part of an opening of the slit in the oscillation region and (ii) integrates the oscillation region separated by the slit, and the slit includes (i) a covered region in which the opening is covered by the stretchable film and (ii) a non-covered region in which the opening is not covered by the stretchable film.

3. The piezo-electric element according to claim 2, wherein the slit is extended from the peripheral portion toward a center of the oscillation region.

4. The piezo-electric element according to claim 3, wherein the slit has a larger slit width in the than a slit width in the non-covered region.

5. The piezo-electric element according to claim 3, wherein a slit width of each of the covered region and the non-covered region of the slit increases with getting closer to the center from the peripheral portion.

6. The piezo-electric element according to claim 1, wherein the stretchable film is an organic film or a metallic film.

7. The piezo-electric element according to claim 1, wherein at least a partial region of the stretchable film has a bellows shape to be stretchable in an intersecting direction that intersects the thickness direction.

8. The piezo-electric element according to claim 1, wherein a contact surface of the piezo-electric element part with the stretchable film has unevenness.

9. The piezo-electric element according to claim 2, wherein the stretchable film is an organic film or a metallic film.

10. The piezo-electric element according to claim 2, wherein at least a partial region of the stretchable film has a bellows shape to be stretchable in an intersecting direction that intersects the thickness direction.

11. The piezo-electric element according to claim 2, wherein a contact surface of the piezo-electric element part with the stretchable film has unevenness.

* * * * *